US007987976B2

(12) United States Patent
Stowers

(10) Patent No.: US 7,987,976 B2
(45) Date of Patent: Aug. 2, 2011

(54) INTEGRATED CARTON AND BOTTLE OPENER

(75) Inventor: Mark D. Stowers, Royse City, TX (US)

(73) Assignee: SNR Packaging, LLC, Temecula, CA (US)

( * ) Notice: Subject to any disclaimer, the term of this patent is extended or adjusted under 35 U.S.C. 154(b) by 0 days.

(21) Appl. No.: 12/422,805

(22) Filed: Apr. 13, 2009

(65) Prior Publication Data

US 2009/0260486 A1 Oct. 22, 2009

Related U.S. Application Data

(60) Provisional application No. 61/200,083, filed on Nov. 24, 2008, provisional application No. 61/124,084, filed on Apr. 14, 2008, provisional application No. 61/130,901, filed on Jun. 4, 2008.

(51) Int. Cl.
*B65D 75/00* (2006.01)

(52) U.S. Cl. ..... 206/139; 206/216; 206/427

(58) Field of Classification Search ..... 206/216, 206/139, 198, 427, 549; 81/3.09
See application file for complete search history.

(56) References Cited

U.S. PATENT DOCUMENTS

| | | | | | |
|---|---|---|---|---|---|
| 1,060,674 | A * | 5/1913 | Foster | 81/3.09 |
| D144,839 | S | 5/1946 | Coles | |
| D171,311 | S | 1/1954 | Schaefer | |
| 2,806,393 | A * | 9/1957 | Vickers | 81/3.09 |
| 2,821,101 | A * | 1/1958 | Hendricks | 81/3.09 |
| 2,875,654 | A * | 3/1959 | Straub | 81/3.15 |
| 2,990,972 | A * | 7/1961 | Benedetti | 206/198 |
| D193,477 | S | 8/1962 | Britton | |
| 3,055,541 | A * | 9/1962 | Bonkowski | 206/198 |
| 3,120,140 | A * | 2/1964 | Wiles | 81/3.09 |
| 4,335,814 | A * | 6/1982 | Benning et al. | 206/198 |
| 4,923,392 | A | 5/1990 | Moynihan, III | |
| 5,531,365 | A | 7/1996 | Donnelly | |
| 5,617,597 | A | 4/1997 | Reitz | |
| D409,464 | S | 5/1999 | Garza | |
| D461,427 | S | 8/2002 | Braner | |
| D473,437 | S | 4/2003 | Klein et al. | |
| 6,851,147 | B2 | 2/2005 | Abrahall | |
| D557,089 | S * | 12/2007 | Menard | D8/34 |
| 7,568,250 | B2 * | 8/2009 | Menard-Flanagan | 7/151 |

* cited by examiner

*Primary Examiner* — David T Fidei
(74) *Attorney, Agent, or Firm* — Jackson Walker L.L.P.; Christopher J. Rourk

(57) ABSTRACT

A container package that includes a structural component for holding a plurality of containers, and an opener affixed to the structural component and configured to allow a user to open one of the plurality of containers without removing the opener from the structural component.

5 Claims, 9 Drawing Sheets

INTEGRATED CARTON AND BOTTLE OPENER

RELATED APPLICATIONS

This application claims priority to provisional U.S. application 61/200,083, filed Nov. 24, 2008, provisional U.S. application 61/124,084, filed Apr. 14, 2008, and provisional U.S. application 61/130,901, filed Jun. 4, 2008, each of which are hereby incorporated by reference for all purposes.

FIELD OF THE INVENTION

The invention relates to beverage packaging, and more particularly to beverage packaging that incorporates an opener for beverage containers contained within the beverage packaging.

BACKGROUND OF THE INVENTION

Clip-on bottle openers are known in the art. While such clip-on bottle openers could be provided with a beverage container simply clipped on to the beverage container packaging, beverage containers and the associated packaging are mass-produced, and transportation and handling would cause prior art clip-on bottle openers that are provided with the beverage container packaging at the manufacturing facility to fall off the beverage container package.

SUMMARY OF THE INVENTION

In accordance with the present invention, an apparatus and method for providing a beverage container opener that is integrated with a beverage container package and which can be used to open beverage containers contained in the beverage container package without destroying the integrity of the beverage container package are provided.

In particular, a container package is provided that includes a structural component for holding a plurality of containers, such as a six-pack bottle carton. An opener affixed to the six-pack bottle carton is configured to allow a user to open one of the bottles, such as by removing a bottle cap from a bottle, without removing the opener from the six-pack bottle carton.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
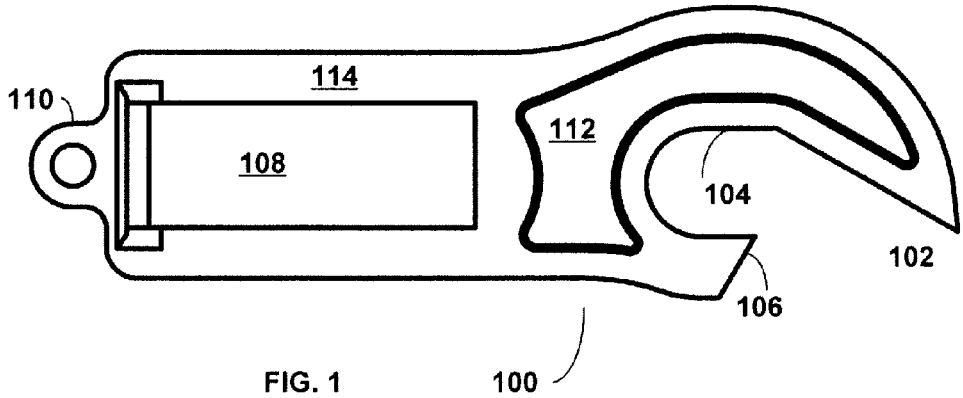
FIG. 1 is a diagram of a beverage container opener in accordance with an exemplary embodiment of the present invention.

In the description that follows, like parts are marked throughout the specification and drawings with the same reference numerals, respectively. The drawing figures might not be to scale and certain components can be shown in generalized or schematic form and identified by commercial designations in the interest of clarity and conciseness.

FIG. 1 is a diagram of a beverage container opener 100 in accordance with an exemplary embodiment of the present invention. Beverage container opener 100 can be incorporated securely onto a beverage container package and used without destroying the integrity of the beverage container package, thus allowing the remaining beverage containers to be held by the beverage container packaging.

Beverage container opener 100 can be made of metal, plastic, composites, wood, ceramic or any other suitable material that provides sufficient structural strength to allow beverage container opener 100 to be used by a user to apply a force to a beverage container seal, such as a bottle cap or a metal can lid, and to thereby remove the seal or otherwise open the beverage container. While the exemplary embodiments disclosed herein are described in regards to beverage containers, any suitable container that requires an opener could also or alternatively be used, such as a liquid container for automotive liquids, cleaning liquids, insecticide liquids or other liquids, a solid container for granulated solids such as salt, sugar or fertilizer, or any other suitable container.

Beverage container opener 100 includes edge 102, cavity 104 and edge 106, which are configured to allow a bottle, can or other container to be inserted into cavity 104 and for an external force to be applied to the container using edge 102 and edge 106 as lever points. In this manner, a bottle cap can be removed, such as by placing edge 106 underneath the bottle cap and applying force to edge 102 to cause the bottle cap to deform and become dislodged from the bottle. Likewise, a can may be opened by placing edge 106 on the side of the can and edge 102 on top of the can, and applying force to edge 102 to cause the edge 102 to puncture the material on top of the can. Other suitable manners of using beverage container opener 100 to open a container can also or alternatively be used.

Cavity 112 is provided to decrease the amount of material required to manufacture beverage container opener 100, and is optional. Cavity 112 is configured to remove additional material that is not required to allow beverage container opener 100 to be used to apply force to a container.

Body 114 is used as a handle, a support, for attachment to the beverage container packaging, or for other suitable purposes. As will be described herein, body 114 allows a user to hold beverage container opener 100, such as after beverage container opener 100 has been removed from a beverage container package (potentially resulting in the destruction of the beverage container package), and also allows beverage container opener 100 to be secured to a beverage container package in a manner that allows beverage container opener 100 to be used with impairing the integrity of the beverage container package.

Clip 108 extends from body 114, and provides additional stability to secure beverage container opener 100 to a beverage container package in certain configurations. A cavity (not expressly shown) is provided, so as to reduce the amount of material required to manufacture beverage container opener 100, and also to allow clip 108 to extend into the cavity, such that when beverage container opener 100 is clipped onto a beverage container package or any other item, a positive force is created that holds beverage container opener 100 onto the beverage container package or other item.

Connector 110 is used to provide a connection to a beverage container package in certain configurations, and can also be used to attach beverage container opener 100 to a key ring or other suitable location after beverage container opener 100 has been removed from the beverage container package.

Figure 2:
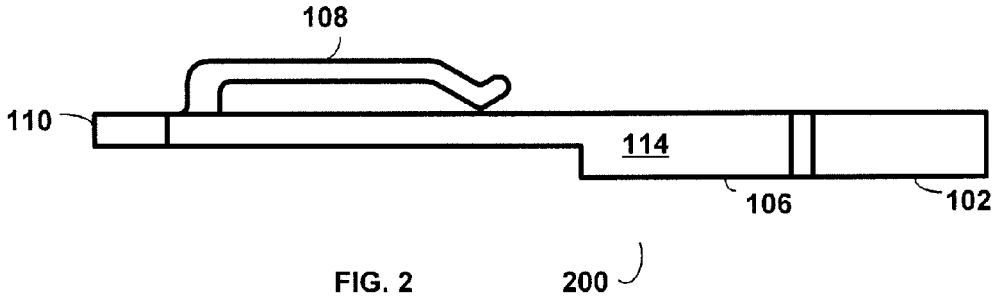
FIG. 2 is a side view of a beverage container opener in accordance with an exemplary embodiment of the present invention.

FIG. 2 is a side view 200 of beverage container opener 100 in accordance with an exemplary embodiment of the present invention. As shown in side view 200, clip 108 of beverage container opener 100 can extends downwards into the cavity (not expressly shown) of body 114.

Figure 3:
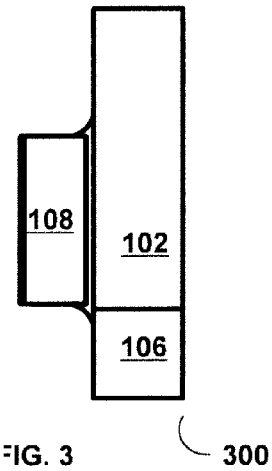
FIG. 3 is an end view of a beverage container opener in accordance with an exemplary embodiment of the present invention.

FIG. 3 is an end view 300 of beverage container opener 100 in accordance with an exemplary embodiment of the present invention. End view 300 is the view from the right-hand side of FIG. 1, and shows edges 102 and 106 and clip 108.

Figure 4:
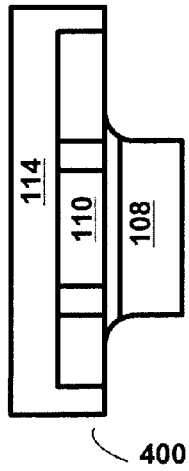
FIG. 4 is an end view of a beverage container opener in accordance with an exemplary embodiment of the present invention.

FIG. 4 is an end view 400 of beverage container opener 100 in accordance with an exemplary embodiment of the present invention. End view 400 is the view from the left-hand side of FIG. 1, and shows portions of body 114, connector 110 and clip 108. It is noted that body 114 can be thicker at edges 102 and 106, to provide additional strength for use in opening containers.

Figure 5:
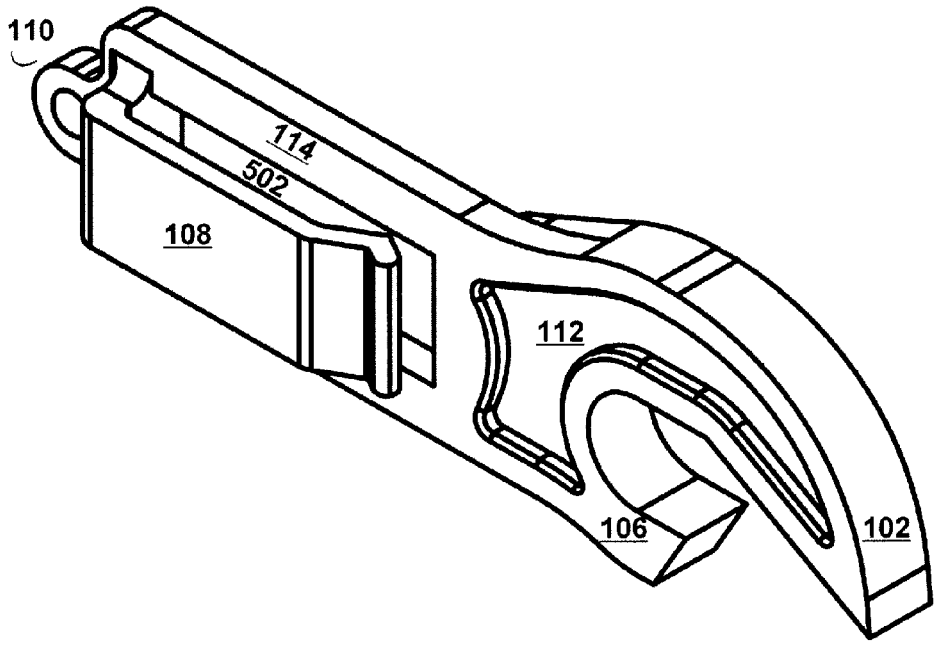
FIG. 5 is a perspective view of a beverage container opener in accordance with an exemplary embodiment of the present invention.

FIG. 5 is a perspective view 500 of beverage container opener 100 in accordance with an exemplary embodiment of the present invention. Perspective view 500 shows cavity 502 in body 114, which allows clip 108 to be formed so as to be flush with or extend into cavity 502. As previously discussed, this configuration provides additional force when beverage container opener 100 is placed on a beverage container package or other item using clip 108, thus helping to ensure that beverage container opener 100 does not fall off the beverage container package or other item during handling.

Figure 6:
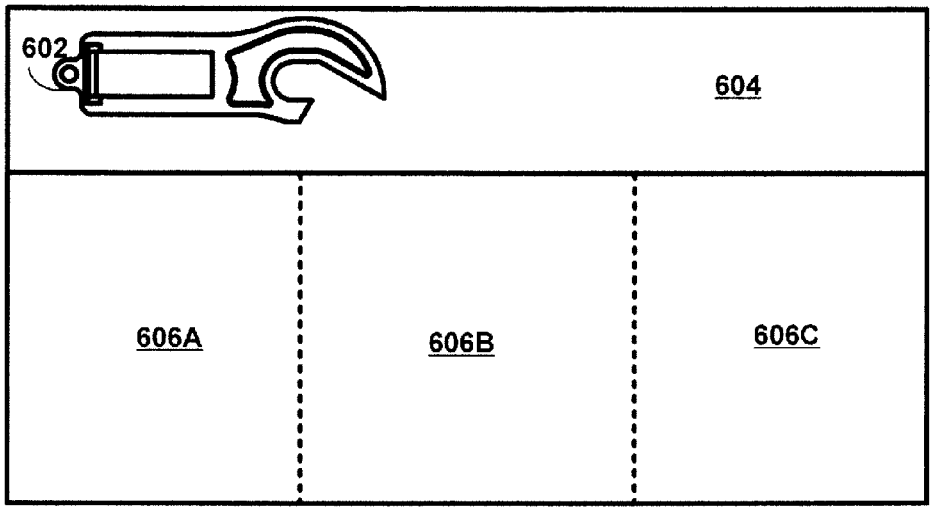
FIG. 6 is a diagram of a beverage container package with a beverage container opener in accordance with an exemplary embodiment of the present invention.

FIG. 6 is a diagram of a beverage container package 600 with beverage container opener 100 in accordance with an exemplary embodiment of the present invention. The dotted lines indicate the location of internal compartment divisions 606A through 606C that are used to hold individual beverage containers. Beverage container package 600 includes mechanical attachment device 602, such as a rivet, a bolt, a grommet or other suitable devices, which extends though connector 110 of beverage container opener 100 and a top portion 604 of beverage container package 600, which incorporates or is used as a handle for beverage container package 600. In this manner, beverage container opener 100 can be attached to beverage container package 600 and can be swiveled upwards to allow it to be used to open a beverage container, after which it can be returned to the position shown in FIG. 6. A slight amount of adhesive can also be applied to beverage container opener 100, so as to prevent beverage container opener 100 from being dislodged during manufacture and shipment, but not sufficient to cause beverage container package 600 to be damaged when beverage container opener 100 is deployed for use.

Figure 7:
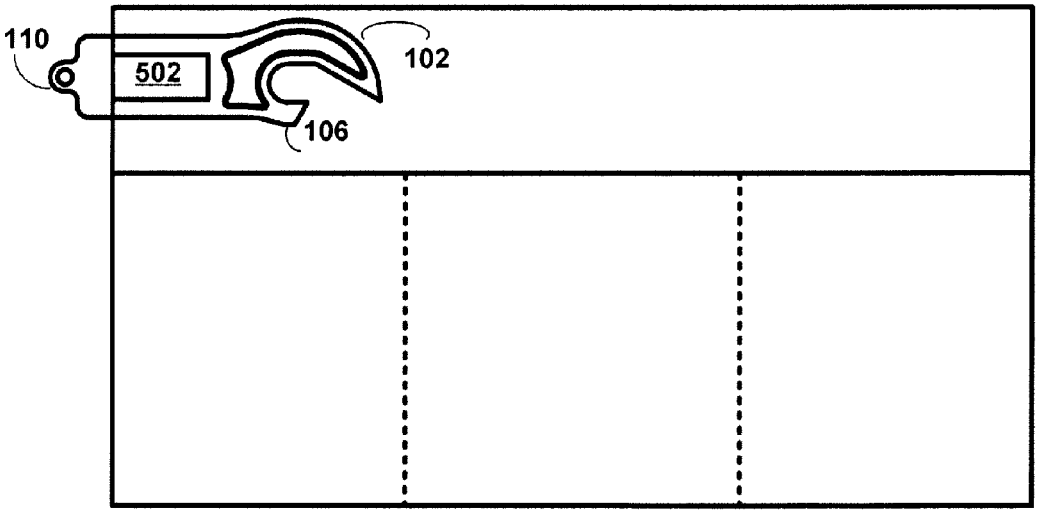
FIG. 7 is a diagram of a beverage container package with another configuration of a beverage container opener in accordance with an exemplary embodiment of the present invention.

FIG. 7 is a diagram of a beverage container package 700 with another configuration of beverage container opener 100 in accordance with an exemplary embodiment of the present invention. Beverage container package 700 includes beverage container opener 100 clipped onto the top portion of beverage container package 700, and a slight amount of adhesive can also be applied to beverage container opener 100, so as to prevent beverage container opener 100 from being dislodged during manufacture and shipment, but not sufficient to cause beverage container package 700 to be damaged when beverage container opener 100 is deployed for use. Beverage container opener 100 can then be returned to beverage container package 700 after use using clip 108.

Figure 8:
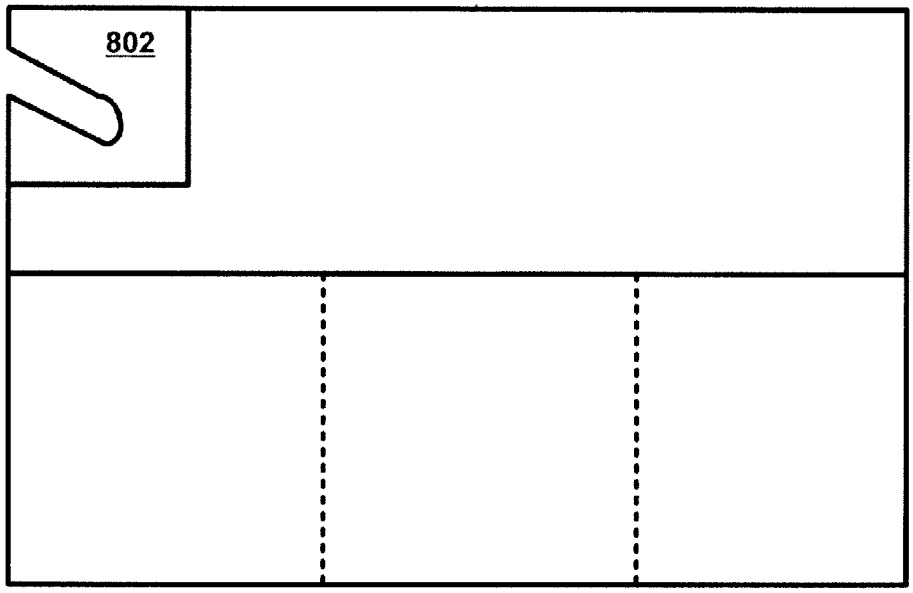
FIG. 8 is a diagram of a beverage container package having alternative an beverage container opener in accordance with an exemplary embodiment of the present invention.

FIG. 8 is a diagram of a beverage container package 800 having alternative beverage container opener 802 in accordance with an exemplary embodiment of the present invention. Beverage container opener 802 can be slid onto beverage container package 800 in a convenient location, such as at the corner of the top portion of beverage container package 800 as shown or in other suitable locations. Beverage container opener 802 can be secured in position with an adhesive.

Figure 9:
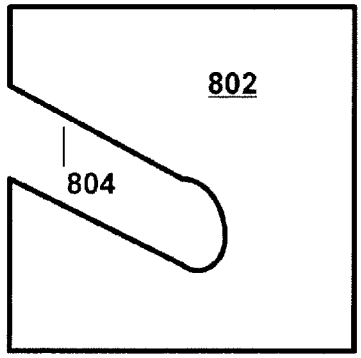
FIG. 9 is a diagram of a beverage container opener in accordance with an exemplary embodiment of the present invention.

FIG. 9 is a diagram 900 of beverage container opener 802 in accordance with an exemplary embodiment of the present invention. As shown in diagram 900, beverage container opener 802 includes slot 804, which is configured to allow the closure of a container, such as a bottle cap of a bottle, to be inserted into slot 804, so that a user can apply a force to the bottle and remove the bottle cap.

Figure 10:
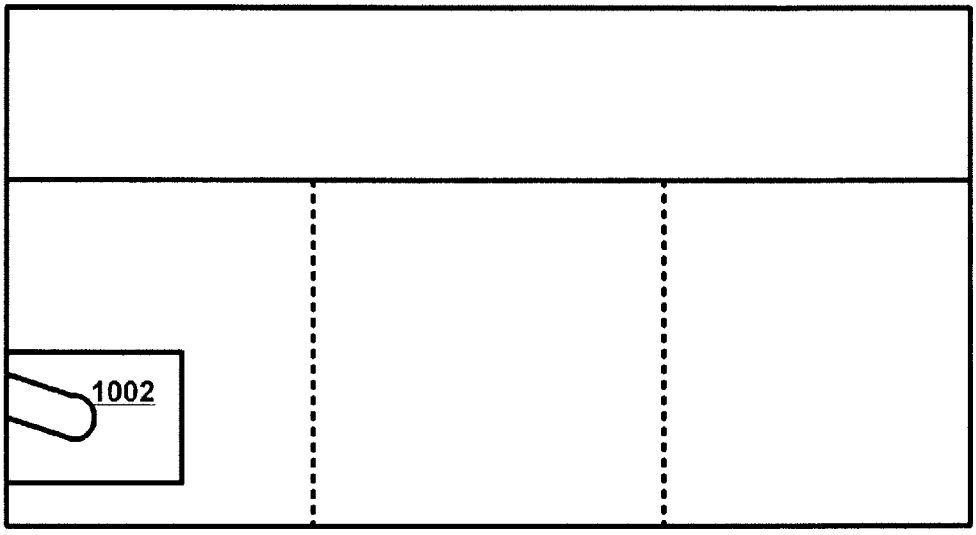
FIG. 10 is a diagram of a beverage container package with a different embodiment of a beverage container opener in accordance with an exemplary embodiment of the present invention.
Figure 11:
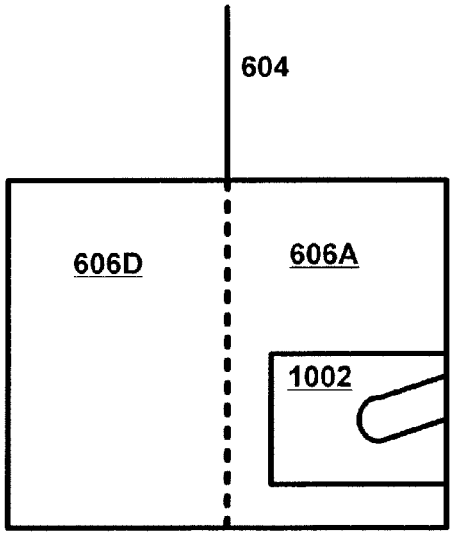
FIG. 11 is a side view of a beverage container package.

FIG. 10 is a diagram of beverage container package 1000 with a different embodiment of a beverage container opener 1002 in accordance with an exemplary embodiment of the present invention. Beverage container opener 1002 can be secured using an adhesive or in other suitable manners onto the bottom portion of beverage container package 1000, such as at a corner of one of the sub-compartments of beverage container package 1000. This is further shown in FIG. 11, which is a side view 1100 of beverage container package 1000. Beverage container opener 1002 can be used to receive additional structural support from beverage container package 1000, such as where the top portion 604 is not structurally strong enough to provide support for beverage container opener 802, or in other suitable embodiments, such as where the beverage container package does not have a top portion 604 and is an enclosed carton. Also shown are compartments 606A and 606D, and top portion 604 can be part of a structural divider that separates the various compartments of beverage container package 1000.

Figure 12:
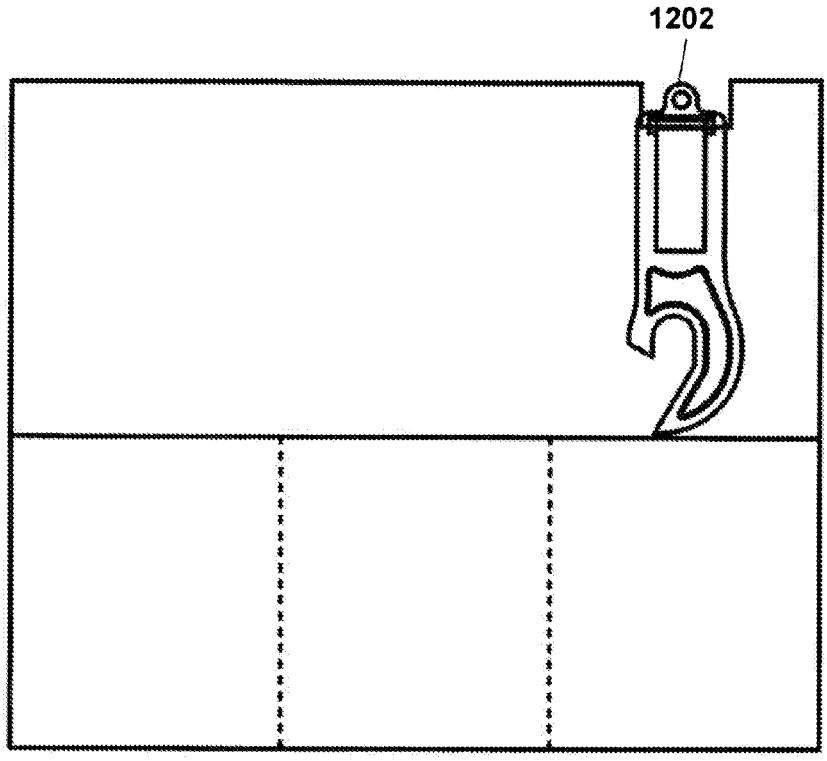
FIG. 12 is a diagram of a beverage container package with a cut-out in accordance with an exemplary embodiment of the present invention.

FIG. 12 is a diagram of a beverage container package 1200 with a cut-out in accordance with an exemplary embodiment of the present invention. Beverage container package 1200 includes cut-out 1202, which is used to hold beverage container opener 100. Adhesive can also be used where necessary, but cut-out 1202 may provide sufficient structural support for beverage container opener 100 to prevent it from being dislodged during manufacture and shipping. Cut-out 1202 can also be formed in a manner that provides additional structural support, such as by adding a lip that extends over beverage container opener 100, a break-away cover over cut-out 1202, or in other suitable manners.

Figure 13:
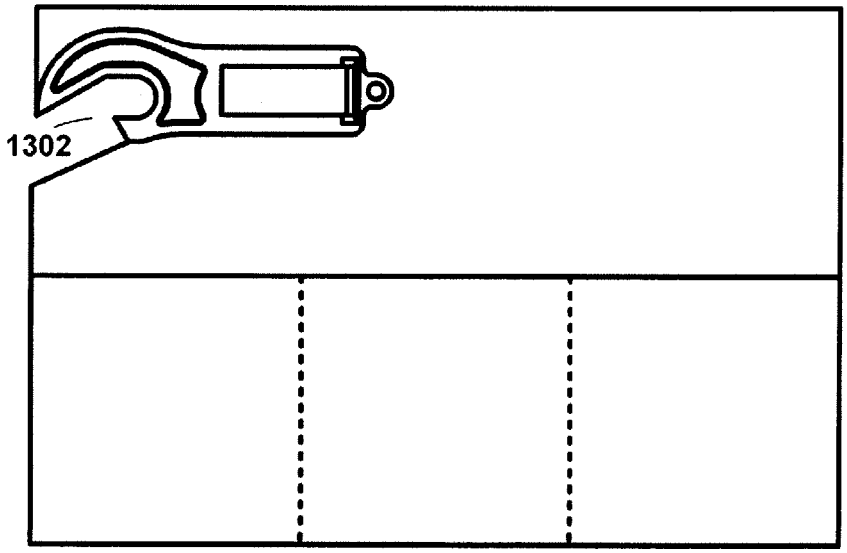
FIG. 13 is a diagram of a beverage container package with a beverage container opener in a different exemplary configuration.

FIG. 13 is a diagram of a beverage container package 1300 with beverage container opener 100 in a different exemplary configuration. Beverage container package 1300 includes cut-out 1302, which allows beverage container opener 100 to be secured to beverage container package 1300 in a manner that permits use of beverage container opener 100 without the need to remove beverage container opener 100 from beverage container package 1300. Cut-out 1302 allows a user to insert a container seal, such as a bottle cap, into cavity 104 of beverage container opener 100 without removing beverage container opener 100 from beverage container package 1300. Beverage container opener 100 can be secured to beverage container package 1300 with adhesive, using a rivet, bolt, grommet or other suitable fastener that extends through connector 110, or in other suitable manners.

In operation, a beverage container opener is provided with a beverage container package in a configuration that ensures that the beverage container opener will not become dislodged during manufacture or shipping, but which allows a consumer to use the beverage container opener, either while it is attached to the beverage container package or by removing it from the beverage container package without causing damage to the beverage container package. In this manner, consumers can purchase beverages in containers that require openers with packaging that incorporates the opener, thus facilitating sales and consumption of such packaged beverages.

Figure 14:
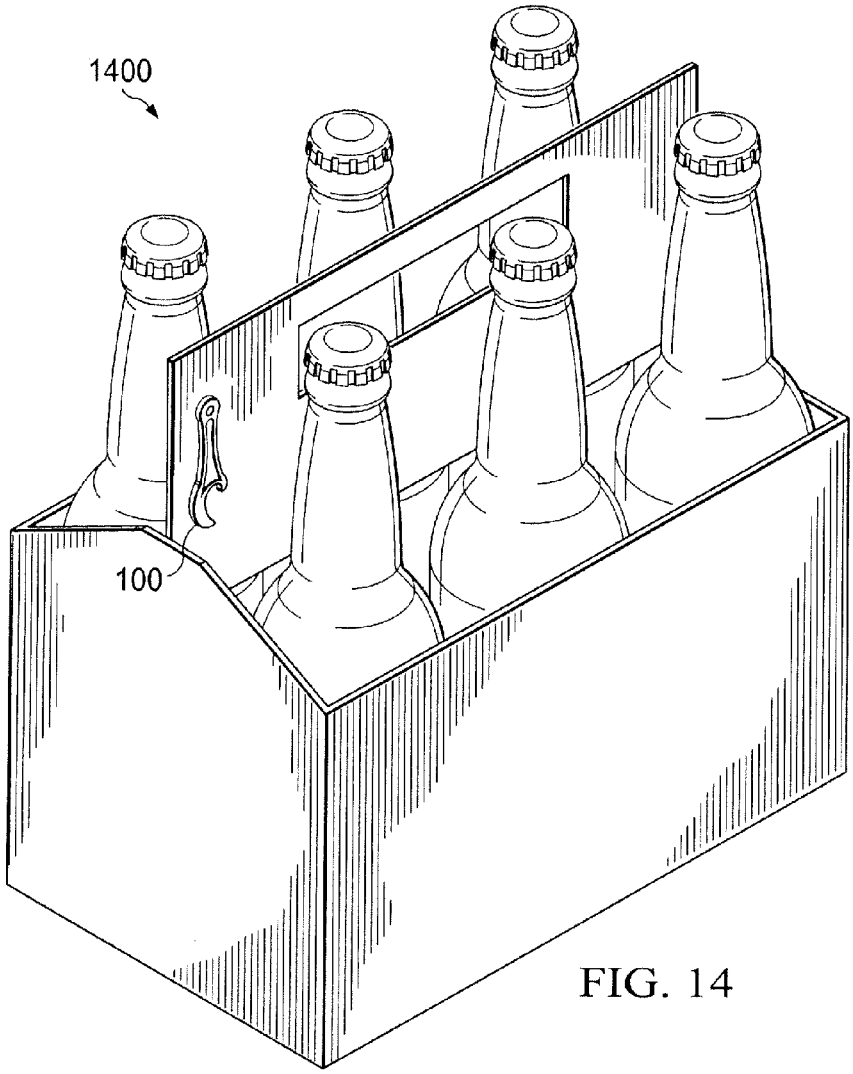
FIG. 14 is a diagram of a beverage container package with beverage containers and beverage container opener in accordance with an exemplary embodiment of the present invention.

FIG. 14 is a diagram of a beverage container package 1400 with beverage containers and beverage container opener 100 in accordance with an exemplary embodiment of the present invention. Beverage container opener 100 is affixed to beverage container package 1400 by a mechanical attachment, such as with a bolt, rivet, grommet or other suitable devices. Beverage container opener 100 can also be held in place with a light amount of adhesive. In operation, a user can remove a bottle from beverage container package 1400 and can swivel beverage container opener 100 so as to allow it to be used to open the bottle, without damaging the integrity of beverage container package 1400.

Figure 15:
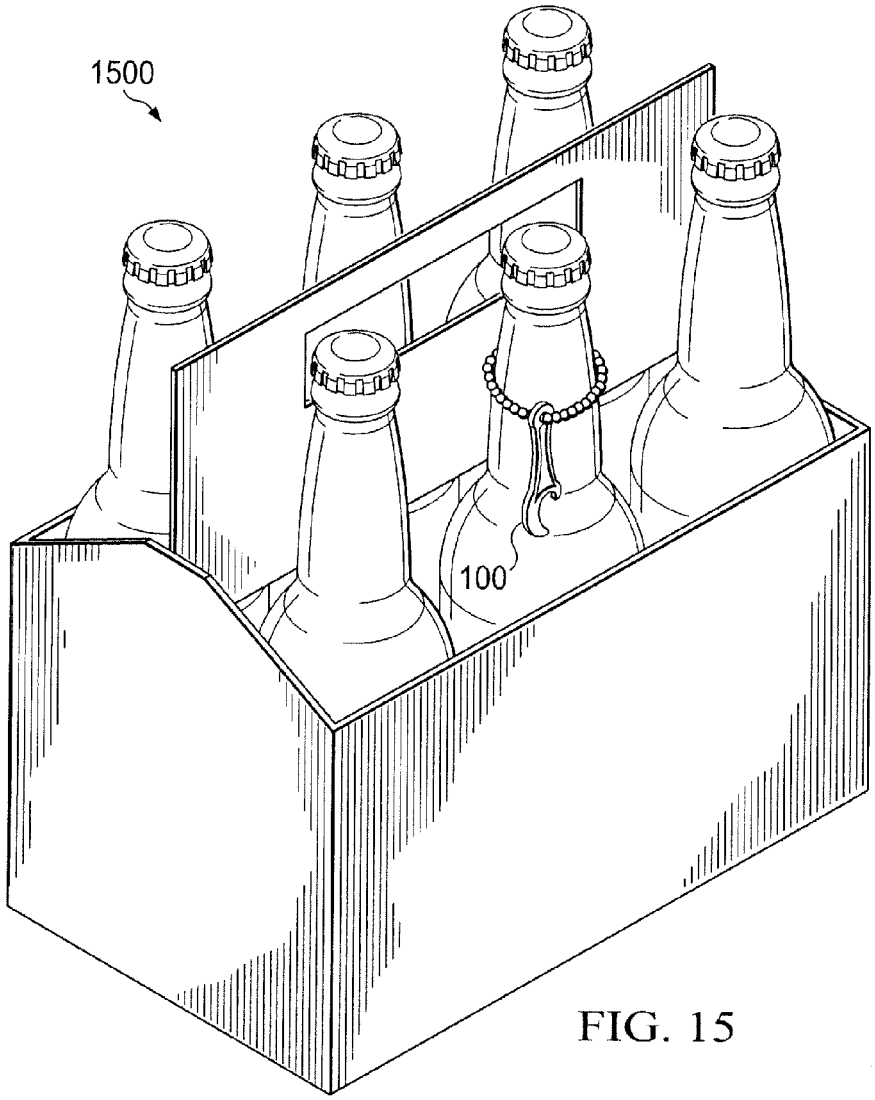
FIG. 15 is a diagram of a beverage container package with beverage containers and beverage container opener in accordance with an exemplary embodiment of the present invention.

FIG. 15 is a diagram of a beverage container package 1500 with beverage containers and beverage container opener 100 in accordance with an exemplary embodiment of the present invention. Beverage container opener 100 is affixed to beverage container package 1500 by a attachment to one of the beverage containers, such as by a chain that is held in place with a light amount of adhesive. In operation, a user can remove a bottle from beverage container package 1500 and can remove beverage container opener 100 from the bottle, so as to allow it to be used to open the bottle, without damaging the integrity of beverage container package 1500. The chain allows the user to replace the beverage container opener 100 on another bottle of beverage container package 1500, thus maintaining the integrity of beverage container package 1500. While the chain will no longer be held by an adhesive, the adhesive is only required to prevent loss of beverage container opener 100 during manufacturing and shipping.

Figure 16:
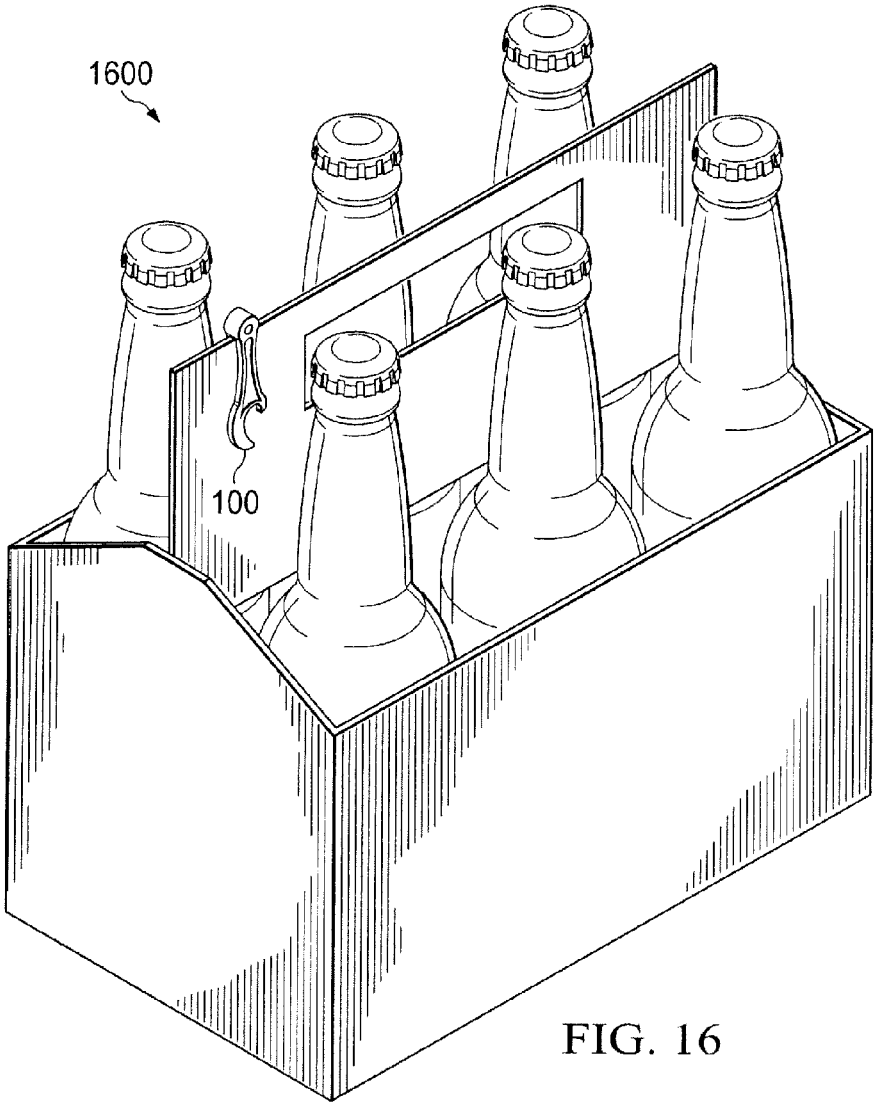
FIG. 16 is a diagram of a beverage container package with beverage containers and beverage container opener in accordance with an exemplary embodiment of the present invention.

FIG. 16 is a diagram of a beverage container package 1600 with beverage containers and beverage container opener 100 in accordance with an exemplary embodiment of the present invention. Beverage container opener 100 is affixed to beverage container package 1600 by a attachment, such as by clipping and by use of a light amount of adhesive to prevent beverage container opener from being dislodged during manufacture and shipment. In operation, a user can remove a bottle from beverage container package 1600 and can remove beverage container opener 100 from beverage container package 1600, so as to allow it to be used to open the bottle, without damaging the integrity of beverage container package 1600. The clip allows the user to replace the beverage container opener 100 on beverage container package 1600, thus maintaining the integrity of beverage container package 1600. While the clip will no longer be held by an adhesive, the adhesive is only required to prevent loss of beverage container opener 100 during manufacturing and shipping.

While certain exemplary embodiments have been described in detail and shown in the accompanying drawings, it is to be understood that such embodiments are merely illustrative of and not restrictive on the broad invention. It will thus be recognized to those skilled in the art that various modifications may be made to the illustrated and other embodiments of the invention described above, without departing from the broad inventive scope thereof. It will be understood, therefore, that the invention is not limited to the particular embodiments or arrangements disclosed, but is rather intended to cover any changes, adaptations or modifications which are within the scope and the spirit of the invention defined by the appended claims.

What is claimed is:

1. A container package comprising:

a structural component for holding a plurality of containers; and an opener affixed to the structural component and configured to allow a user to remove the opener from the structural component without damaging the structural component, wherein the opener is affixed to an exterior surface of the structural component using a fastening element and wherein the opener further comprises:

a clip extending from a body of the opener; and a cavity in the body of the opener opposite the clip, wherein the clip is configured to extend into the cavity, such that when the opener is clipped into a cutout of the structural component, a positive force is created that holds the opener onto the item.

2. The container package of claim 1 wherein the fastening element is an adhesive.

3. The container package of claim 1 wherein the fastening element is a mechanical attachment device.

4. The container package of claim 1 wherein the opener is affixed to the structural component at a top portion that incorporates a handle.

5. The container package of claim 1 wherein the opener is affixed to the structural component at a bottom portion that is a portion of an individual container compartment.

* * * * *